US005515229A

United States Patent [19]

Takeda

[11] Patent Number: 5,515,229

[45] Date of Patent: May 7, 1996

[54] OVERCURRENT PROTECTOR WITH OVERHEAT PREVENTION MEANS

[75] Inventor: Kazuo Takeda, Susono, Japan

[73] Assignee: Texas Instruments Incorporated, Dallas, Tex.

[21] Appl. No.: 262,428

[22] Filed: Jun. 20, 1994

[30] Foreign Application Priority Data

Jul. 5, 1993 [JP] Japan ..... 5-191742

[51] Int. Cl.[6] ..... H01H 37/00

[52] U.S. Cl. ..... 361/105; 361/24; 361/26; 361/32

[58] Field of Search ..... 361/103, 104, 361/105, 106, 23, 26, 32, 22, 24; 337/349, 337, 370, 101

[56] References Cited

U.S. PATENT DOCUMENTS 4,563,667 1/1986 Hofsäss ..... 337/349

4,633,210 12/1986 Mallonen ..... 337/101

*Primary Examiner*—A. D. Pellinen
*Assistant Examiner*—Stephen Jackson
*Attorney, Agent, or Firm*—Russell E. Baumann; Richard L. Donaldson; René E. Grossman

[57] ABSTRACT

An overcurrent protection device for a motor M with an overheat prevention function having a housing 10 with fixed contacts 16, 18 and movable contacts 24, 26. A first snap acting bimetallic element 20 in the device is responsive to heat from overcurrent conditions and a second snap acting bimetallic element 40 is responsive to heat from the temperature for the motor M. The movable contacts 24, 26 are controlled by the first bimetallic element to cause engagement or nonengagement with the stationary contacts 16,18. Coupling members 42, 44 contained in the housing engage both bimetallic elements 20, 40 and allow the first overcurrent bimetallic element 20 to snap independently of the second bimetallic element 40 while providing for snap action of the second bimetallic element 40 to also cause the first bimetallic 20 to snap.

11 Claims, 7 Drawing Sheets

OVERCURRENT PROTECTOR WITH OVERHEAT PREVENTION MEANS

BACKGROUND OF THE INVENTION

This invention relates to an overcurrent protective device for the protection of electrical equipment from electrical overcurrent; and more specifically, to an overcurrent protective device which is equipped with a function of preventing the overheating of the electrical machinery.

FIG. 12 shows the construction of an overcurrent protector or motor protector of the prior art used for the protection of the motor typically in a tightly sealed compressor. The motor protector has an open ended cylindrical casing 10 made of an insulating material with first and second generally U-shaped terminals 12 and 14 extending from the interior of the casing through a top upper surface 10*a* of the casing to the exterior of the casing.

Lower ends of terminals 12 and 14 within casing 10 are bent approximately at a right angle as compared with the central axis of the casing thereby forming fixed contact 16 and 18 for the protector. A bolt 19 is secured within the casing with one end extending from the center of the upper surface 10*a* of the casing, and the other end extending into the interior of the casing. A shaft 19*a* extends from the bottom or the other end of the bolt 19 through a washer 22 on which a disk-shaped bimetal element 20 is installed. On the upper surface of the bimetal element 20 near its periphery, movable contacts 24 and 26 are connected as by welding or the like at positions respectively for making contact with fixed contacts 16 and 18.

In a position of normal operation, the bimetal element 20 is located at a first position where the disk periphery is curved upward with a fulcrum 19*a* as the center, and the movable contacts 24 and 26 are biased into contact with the fixed contacts 16 and 18 respectively. In this closed state, the electric current that has entered from the terminal 12 flows to the terminal 14 through the fixed contact 16, movable contact 24, bimetal 20, movable contact 26 and the fixed contact 18.

A resistance heater 28 made of nichrome wire is positioned in the casing 10 at a surface opposite to the upper surface 10*a* of the casing 10, and generally adjacent the upper surface of the bimetal element 20. As is shown in FIG. 13, resistance heater 28 extends between terminal 14 and a third terminal 15 with a generally rounded shape so as to heat the entire surface of the bimetal 20 as uniformly as possible between the second terminal 14 and the third terminal 15. There is an electric current path that flows from the second terminal 14 through the resistance heater 28 and exits from the third terminal 15 to outside.

The open ended bottom of the casing 10 is closed by a plate 30 made of an insulating material or a metal. This cover plate 30 is for the purpose of securing an electric distance between the object on which this motor protector is installed, such as the surface of a main compressor 32 and the contact part of the switch mechanism, and for preventing any foreign substance from entering the casing 10.

FIG. 14 shows an electrical circuit diagram with the motor protector connected to a motor M. The first terminal 12 is connected to one of the terminals of an electric source 34. The motor 36 in the compressor is connected between the other terminal of the electric source 34 and the third terminal 15. In the absence of a resistance heater 28 inside the motor protector, the terminal 36*a* of the motor 36 is connected to the second terminal 14.

When the switch of the motor protector is in a closed state, the electric current that flows to the motor 36 also flows to the bimetal 20 and the heating resistor 28, and the bimetal 20 is heated by the resistance heat generated in itself and the resistance heater 28. In addition, the bimetal 20 is also heated by the radiant heat from the compressor 32. The extent of this radiant heating is relatively small, however, as compared with the heating due to the aforementioned resistance heating.

Ordinarily, the motor 36 of the compressor 32 requires protection in the case where the electric current has exceeded a rated value because of an overload or a locked rotor state. For example, in the case where the cooling efficiency of a condenser (not shown in the drawing) has decreased appreciably, the amount of work done by the compressor 32 or the load on the motor 36 becomes excessively large, with a result that an overcurrent flows thereby creating a situation where the motor coils may be damaged.

Additionally, in the case where operation of the compressor is started again after the compressor 32 has once stopped and coolant gas of high temperature and high pressure still remains on the exterior side of the compressor, the piston is unable to compress the coolant gas; and thus, there is an abnormal increase in the amount of the electric current to start the motor.

In these cases where the electric current that flows to the motor 36 is increased as described above, heating is increased by the resistance heating which is transmitted to the bimetal element 20 with a result that the temperature of the bimetal element 20 rises. When the temperature rises to a prescribed action temperature such as 160 degrees centigrade, the bimetal element snaps to the second position where the disk periphery curves downward as shown by a dotted line 20' in FIGS. 12 and 14. Thereupon, the movable contacts 24 and 26 which are fixed to the upper surface of the bimetal element 20 are separated from the fixed contacts 16 and 18 respectively; and the switch circuit of the motor protector opens and the electric current is shut off. Because of this shutoff of the electric current, any possible harm to the coil of the motor 36 is prevented.

When the electric current is shut off, heating by resistance heating for the bimetal element 20 stops. When the temperature of the bimetal element 20 is lowered to a prescribed temperature such as, for instance, 80 degrees centigrade, the bimetal 20 snaps from the second position back to the first position, thereby closing the switch circuit. As a result of this action, the electric current flows and the operation of the compressor 32 starts once again.

There are, however, other cases where the motor 36 of the compressor 32 requires protection. If, for example, the coolant leaks out of the compressor due to some reason such as defective installation, there will be a reduction in the amount of the coolant gas of low temperature and low pressure that is circulated and supplied to the compressor 32 from an evaporator in the compressor with a resultant reduction in the cooling effect of the coolant gas in the compressor 32 or motor 36 and; thus, the temperature of the compressor 32 or the motor 36 rises. Since the amount of the coolant gas is small in such a case, the amount of work done by the compressor 32 is reduced, and the electric current that flows is not large enough to be above the rated value of the bimetal element. That is, even though the bimetal element 20 receives a radiant heat from the compressor 32 because of the above, the bimetal element does not snap over center because the main heating by the resistance heating is not sufficient to cause it to raise to a high enough temperature.

Accordingly, the temperature of the compressor 32 or the motor 36 rises with a resultant possibility that the motor coils can be damaged.

To avoid the problem on certain prior art protectors, the bimetal 20 is constructed to snap in response to the radiant heat from the compressor 32, too. If the protector is designed in this manner, however, it becomes difficult to obtain the desired bimetal element action characteristics against the overcurrent at the time of an excessive load or locked rotor condition. That is, the simultaneous provision of an overcurrent protective function and an overheat preventive function in one bimetal switch device has been difficult to accomplish.

In an attempt to overcome this difficulty, a thermostat is often installed on the compressor 32, separately from the motor protector, for shutting off the electric current against an overheating of the compressor 32 as described above; and the switch circuit of this thermostat is connected in series with the switch circuit of the motor protector.

When such a thermostat is provided separately as described above; however, there is an increase in the manufacturing cost and two separate protective devices will be required for the overcurrent protection and overheating prevention, with a result that both handling and installation become increased.

All of these prior art approaches have deficiencies in one or more of performance, complexity, size or cost. Reliability and precise interaction of the various parts and switches has also proven to be of concern.

SUMMARY OF THE INVENTION

Accordingly, it is an object of the present invention to provide an overcurrent protective device with an overheat preventive function which is capable of accurately carrying out both the overcurrent protection and overheat prevention function, while still being simple and small in size and low in cost.

Briefly described, a protector for an electrical device of the present invention comprises a fixed contact means which is electrically connected to said electrical device, a movable contact means positioned to make contact with said fixed contact means, a bimetallic element capable of movement between a first position to cause said movable contact means to engage said fixed contact means and a second position to cause said movable contact means to be separated from said fixed contact means in response to heat generated reflecting the electric current that flows to said electrical device, heat responsive means in thermal communication with said electrical device which is displaced to a prescribed position when said heat responsive means is heated to a prescribed temperature reflecting the temperature of said electrical device, and a coupling means for transmitting the displacement of said heat responsive means to said bimetallic element thereby forcefully moving said bimetallic element from said first to said second position.

Further, a protector of the present invention includes an overcurrent protection means which operates independently of a heat responsive means when there is no overtemperature condition.

Still further, a protector of the present invention includes all of the components in a compact simple housing member. Yet still further, a protector of the present invention includes a provision for only manual reset.

DESCRIPTION OF THE DRAWINGS

Other objects, advantages and details of the motor protection device of this invention appear in the following detailed description of the preferred embodiments of the invention, the detailed description referring to the drawings in which.

DETAILED DESCRIPTION OF THE PREFERRED EMBODIMENTS

The embodiments of this invention will be explained below by referring to FIGS. 1 through 11.

Figure 1:
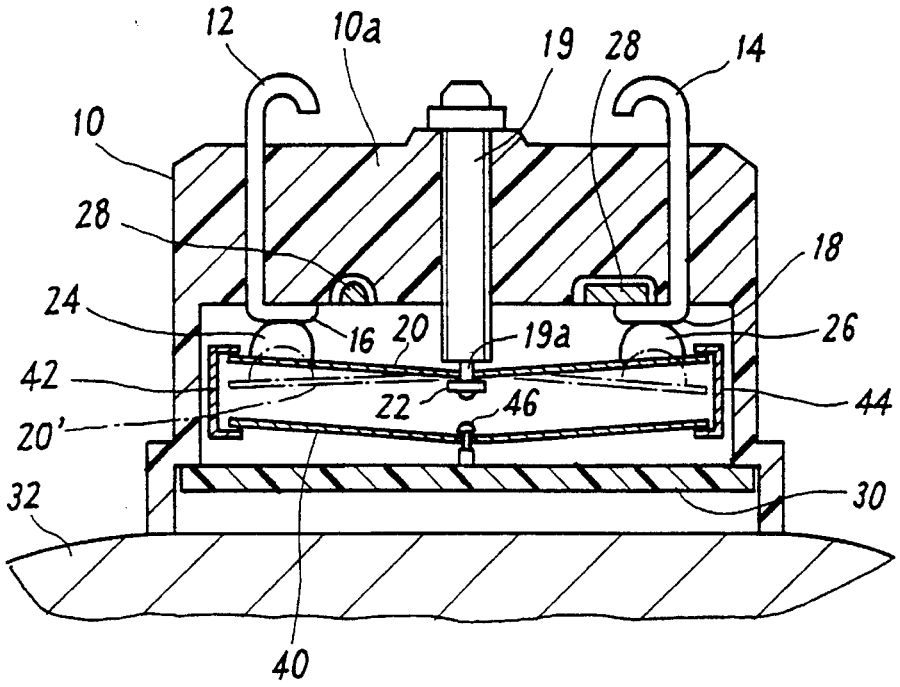
FIG. 1 shows a cross-sectional view of the construction of a protection device according to this invention in the closed contact position.
Figure 2:
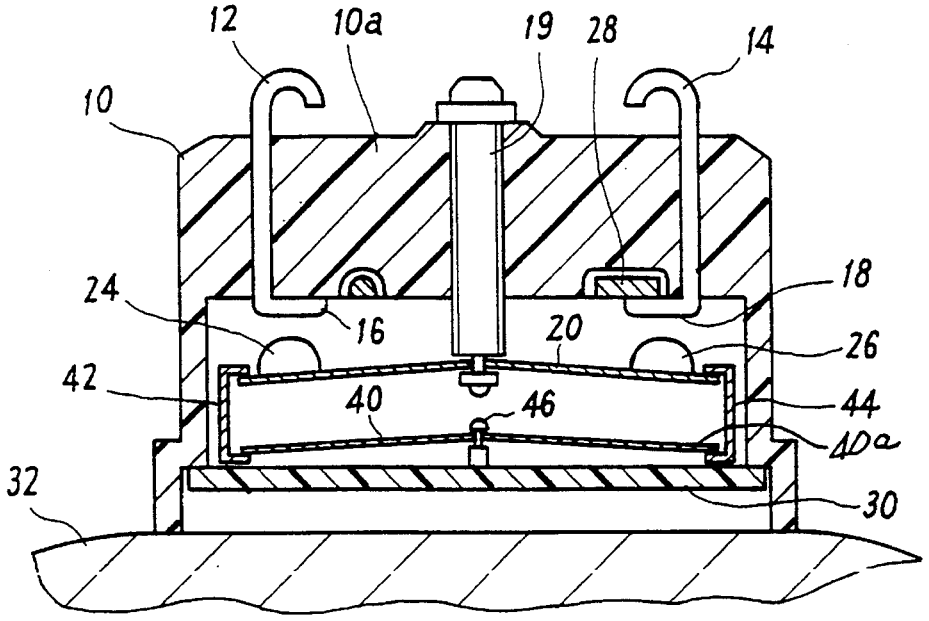
FIG. 2 shows a cross-sectional view of the construction of a protection device shown in FIG. 1 with the contacts in the open position due to said auxiliary bimetal being in said second position.
Figure 13:
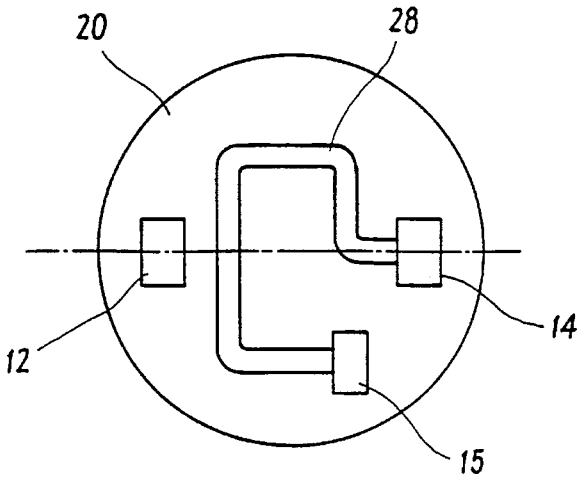
PRIOR ART FIG. 13.
FIG. 13 shows a cross-sectional view taken along line 13— 13-of FIG. 12.
Figure 14:
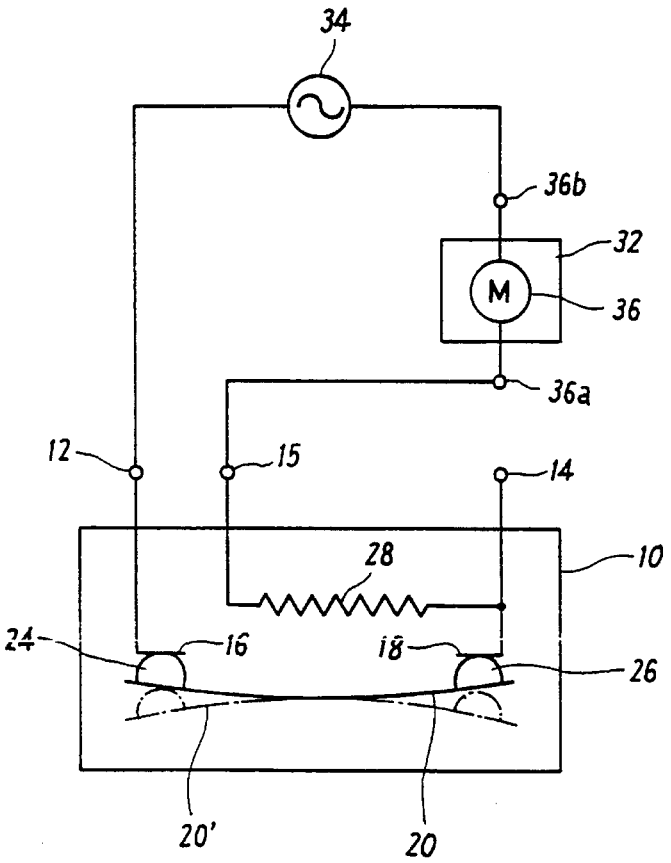
PRIOR ART FIG. 14.
FIG. 14 shows the electrical circuitry of a motor protection system using the protector device of FIG. 12.

FIGS. 1 and 2 show the construction of the overcurrent protective device of the first embodiment of this invention equipped with an overheat preventive function as suitable for use in the protection of the motor of a compressor especially a small-sized compressor of the tightly closed type. In this example and in the other examples, those parts which are common with the various parts according to technology of prior art (refer to FIGS. 12 through 14) are given the same codes.

Figure 12:
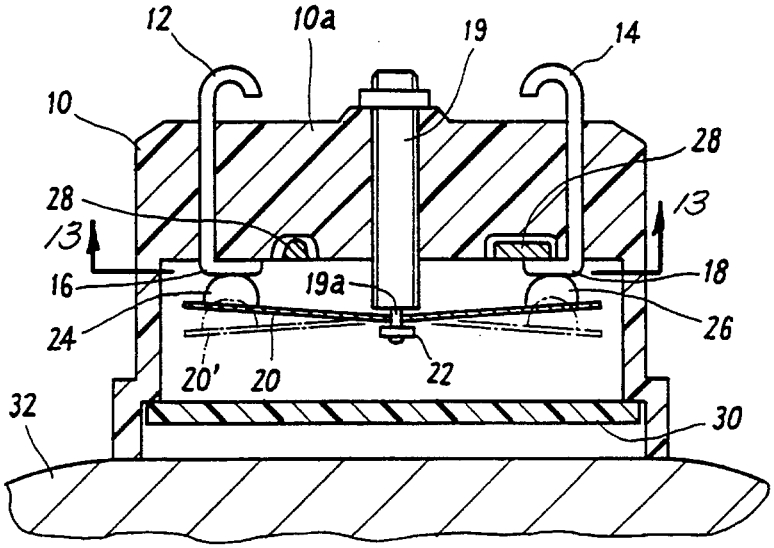
FIG. 12. PRIOR ART
FIG. 12 shows a cross-sectional view of the construction of the protector according to the prior art.

Basically, the protective device according to this example is constructed by adding to the motor protector shown in FIG. 12, an auxiliary bimetal element 40 as a heat responsive member, a pair of coupling members 42 and 44 as the coupling means for transmitting the displacement of this auxiliary bimetal 40 to the main bimetal member 20 and a support axis member 46 as a fulcrum for the auxiliary member 40. This auxiliary bimetal member 40 snap temperature is lower than the snap temperature of bimetal member 20.

The support axis 46 is set up at the center of the covering plate 30, with its tip being inserted into the hole at the center of the auxiliary bimetal element 40, thereby supporting the bimetal 40 approximately horizontally. The coupling members 42 and 44 are formed from a plate member in a U-shape being bent approximately at a right angle at both ends with the respective top bent portions engaging to the upper surface of the peripheral part of the main bimetal element 20 in close proximity to the movable contacts 24 and 26 and the respective bottom bent parts engaging to the lower surface of the peripheral edge of the auxiliary bimetal element 40.

Figure 4:
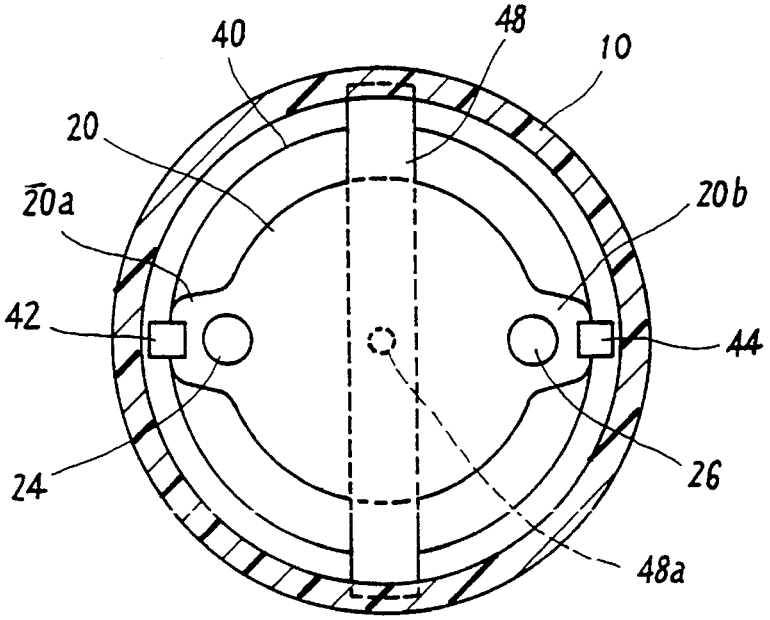
FIG. 4 shows a partial cross-sectional plane view of an essential part of the protection device of FIG. 3.

As is shown in FIG. 4, the main bimetal element 20 has two extensive portions which extend outwardly in a radial direction adjacent movable contacts 24 and 26. The upper bent parts of the coupling members 42 and 44 contact main bimetal element 20 at these extension parts 20*a* and 20*b*.

The auxiliary bimetal element 40 is a disk-shaped bimetal whose spring force is stronger than main bimetal 20. At the normal operational temperature, it is located at a first position where the peripheral edge of the disk is bent upward as is shown in FIG. 1. At the time when it is heated to a prescribed action temperature (lower than the prescribed action temperature of bimetal element 20) such as 130 degrees centigrade in response to the overheating of the compressor, it is so constructed to be displaced or snapped to a second position where the disc peripheral edge is bent downward as is shown in FIG. 2.

At the time when the auxiliary bimetal element 40 is at the first position (regular position) as is shown in FIG. 1, the main bimetal element 20 is capable of snap action of its own between a first position and a second position without being restrained by the coupling members 42 and 44. Thus, as the overcurrent protective function is concerned, the switch functions similarly as in the case of the motor protector shown in FIG. 12 without being effected by auxiliary bimetal element 40.

However, in this protective device with over temperature protection, the radiant heat from the compressor 32 is transmitted to the auxiliary bimetal 40 through the covering plate 30 which is typically made from a thin nonconductive material. Thus, as the temperature of the compressor 32 rises, the temperature of the auxiliary bimetal 40 also rises. Concurrently, since electric current is flowing at this junction, the main bimetal 20 is also heated by the resistance heat in itself and in resistance heater 28, with a result that the temperature of the main bimetal 20 also rises.

When the temperature of the auxiliary bimetal element 40 rises to the predetermined action temperature (for example, 130 degrees centigrade) due to the elevation of the temperature of the compressor 32, the auxiliary bimetal 40 snaps and is displaced from the first position to the second position. Simultaneously, the displacement of this auxiliary bimetal 40 is transmitted to the main bimetal element 20 through the coupling members 42 and 44. Accordingly, main bimetal element 20 receives a downward moment at its extension parts 20*a* and 20*b*, thereby easily providing for it to snap over center and be displaced to the second position. (Reference should be made to FIG. 2.)

As a consequence of the above, the movable contacts 24 and 26 are separated from the fixed contacts 16 and 18, the switch circuit opens, the electric current is shut off, and the operation of the compressor 32 is stopped. In view of the fact that the spring force (strength) of the auxiliary bimetal element 40 is typically far greater than that of the main bimetal element 20, the main bimetal 20 will remain in the second position as long as the auxiliary bimetal 40 remains at the second position.

This is true even if the temperature comes down to the return temperature of the bimetal element 20.

This described feature can provide for a protector which will be nonresettable under certain conditions. That is, there are cases where operation of the motor/compressor should not be carried out until repair work is completed such as if a leak develops of the coolant. Accordingly, the action temperature for the auxiliary bimetal element 40 to return from the second position to the first position can be selected at a temperature which is lower than the normal operating temperature such as −20 degrees centigrade. In this instance, the auxiliary bimetal 40 is returned to the first position only by application of an external force since it would not typically see a temperature of less than −20 degrees C.

Accordingly, in the protective device of this invention which has been described above, upon an overcurrent condition alone, the main bimetal 20 carries out snap action and displacement at a prescribed action temperature, independent of the auxiliary bimetal member 40 acting through coupling members 42 and 44. However, when there is an overheating of the compressor 32 without overcurrent condition, the auxiliary bimetal 40 snaps over center and is displaced causing the main bimetal element 20 to snap over center and be displaced thereby shutting off the electric current.

Accordingly, a single, common set fixed contacts 16 and 18 and movable contacts 24 and 26 can cope with both the overcurrent and overheating conditions. Thus, the increase in the number of the parts required is very small in providing for the overheating function. Moreover, the processing and assembling is simple, with the size of the casing 10 remaining small. Further, the main bimetal element 20 acts essentially unaffected by the auxiliary bimetal element 40 for overcurrent conditions.

Figure 3:
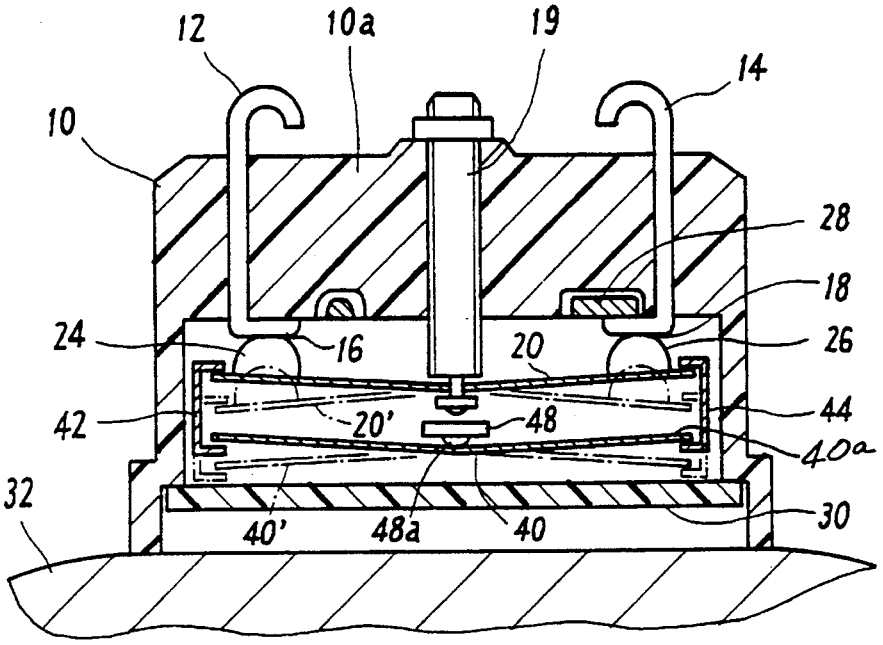
FIG. 3 shows a cross-sectional view of the construction of a protection device according to a second embodiment of this invention.

FIGS. 3 and 4 show the construction of an overcurrent protective device which is equipped with an overheat preventive function according to a second embodiment. This protective device is the same as the protective device shown above in the first embodiment with exception of the support axis 46 which is replaced by a support plate 48.

In this second embodiment, a support plate 48 is mounted to the inner wall of the casing 10 by any conventional manner in such a way as will not interfere with the coupling members 42 and 44 and to engage the top surface 40*a* of the auxiliary bimetal element 40. That is, a protuberant part 48*a* which has been solidly fixed to or formed integrally with the support plate 48 engages and slightly deforms the center of the upper surface of the auxiliary bimetal 40 as a fulcrum. According to such a construction, there is no need to pierce a hole at the center of the auxiliary bimetal 40; and accordingly, the strength of the bimetal element 40 will tend to be stronger and have an increased life.

Figure 5:
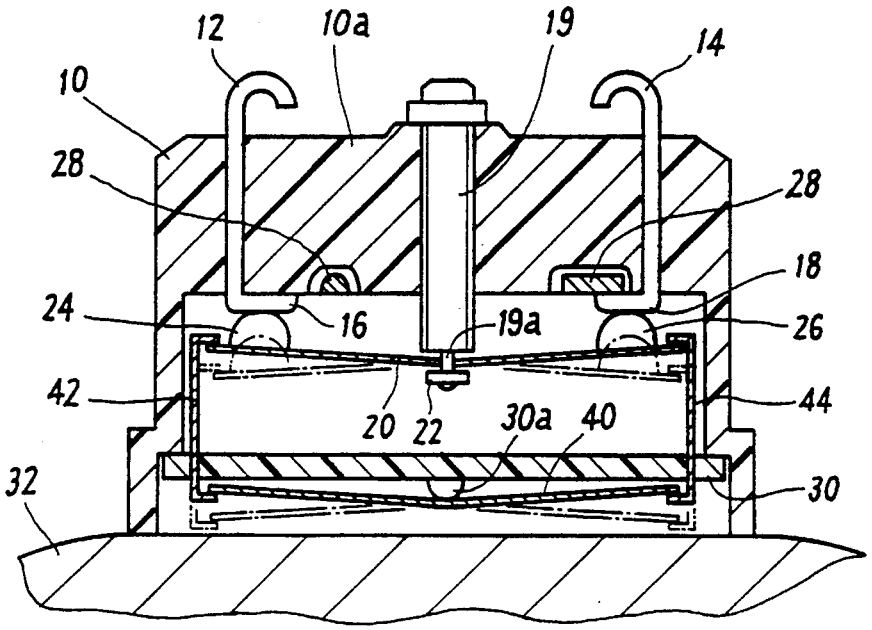
FIG. 5 shows a cross-sectional view of the construction of a protection device according to a third embodiment of the invention.

FIG. 5 shows the construction of the protective device according to a third embodiment. In this protective device, an auxiliary bimetal 40 is arranged outside of the covering plate 30 so as to directly receive the radiant heat from the compressor 32. The fulcrum for the auxiliary bimetal 40 is provided by a protuberant part 30*a* which has been formed integrally with or fixed to the lower surface of the center of the covering plate 30. The coupling members 42 and 44 extend through the covering plate 30, with the respective bottoms being brought close to the surface of the compressor 32. For securing electric insulation, therefore, the coupling members 42 and 44 may be made of an insulating material. According to such a construction, the auxiliary bimetal 40 directly receives the radiant heat from the compressor 32, with a result that it becomes possible to carry out a shutoff action with a fast response action against the overheating of the compressor 32.

Since the auxiliary bimetal 40 is supported by the protuberant support 30*a*, even in this construction there is no need to provide a hole in the auxiliary bimetal 40.

Figure 6:
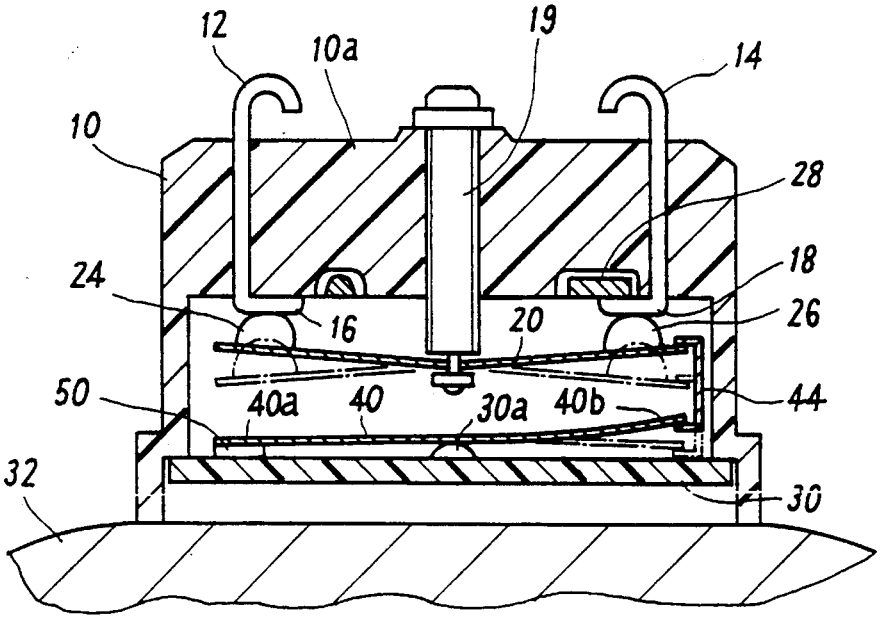
FIG. 6 shows a cross-sectional view of the construction of a protection device according to a fourth embodiment of this invention.

FIG. 6 shows the construction of a protective device according to a fourth embodiment. In this protective device, the auxiliary bimetal 40 is arranged so that one of the terminal parts 40*a* positioned directly under and adjacent contacts 16 and 24 is fixed to the covering plate 30 either by means of welding or binder 50, etc., and the other terminal part 40*b* is positioned opposite to the contacts 18 and 26 being received in the coupling member 44 with the center preferably supported by the protuberant part 30*a* on the surface of covering plate 30.

When the auxiliary bimetal 40 of the cantilever type snaps and is displaced from the first position indicated by the solid line to the second position indicated by the dotted line, the coupling member 44 causes a similar displacement to occur to main bimetal element 20. That is, main bimetal element 20 snaps overcenter and is displaced to the second position indicated by the dotted line with a result that the switch circuit opens.

In this example, the force given from the auxiliary bimetal 40 to the main bimetal 20 or the driving force is typically not as great as in embodiments 1 through 3 as described above. In this regard, it is important to note at the time when the auxiliary bimetal 40 has been heated to its action temperature, the main bimetal 20 is also heated to a temperature approaching its said action temperature; and thus, assumes a state in which it will be snap over center and be displaced even under a comparatively small external force.

Figure 7:
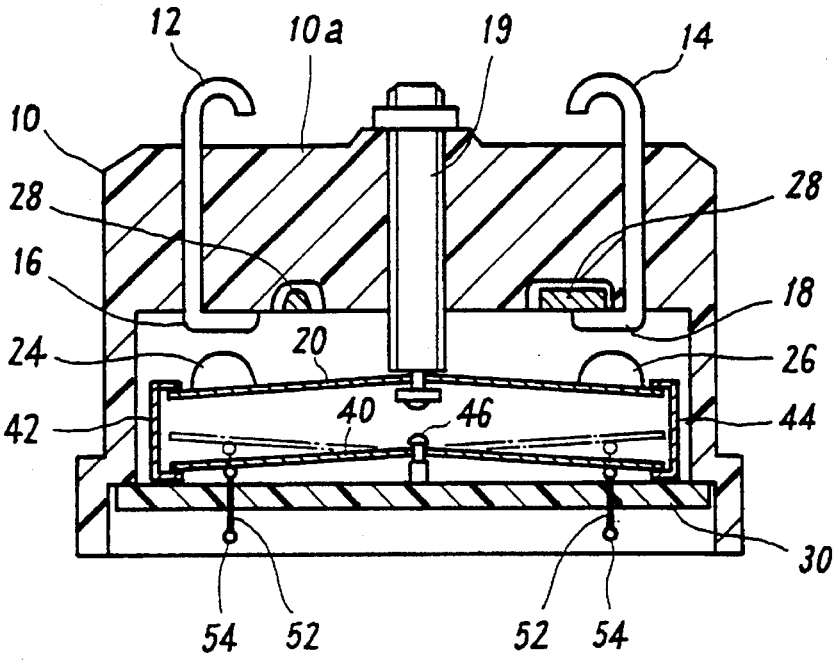
FIG. 7 shows a cross-sectional view of the construction of a protection device according to a fifth embodiment of this invention.

FIG. 7 shows the construction of the protective device according to the embodiment with a manual reset feature. In the case where there is a coolant leakage in, for example, the compressor, the operation should not be started again until the coolant is replenished. Because of this fact, the auxiliary bimetal 40 should not automatically return to the first position at normal temperature and should be returned only by an external force.

In this example, an operating bar 52 for the manual reset or return is freely inserted at a plurality of locations on the covering plate 30 positioned opposite to the peripheral edge of the auxiliary bimetal 40 and a manually operated button 54 is provided at the outside edge of each operating bar 52. When these operating buttons 54 are pushed upward (inward), the auxiliary bimetal 40 can be returned to the first position which is indicated by a dotted line.

Figure 8:
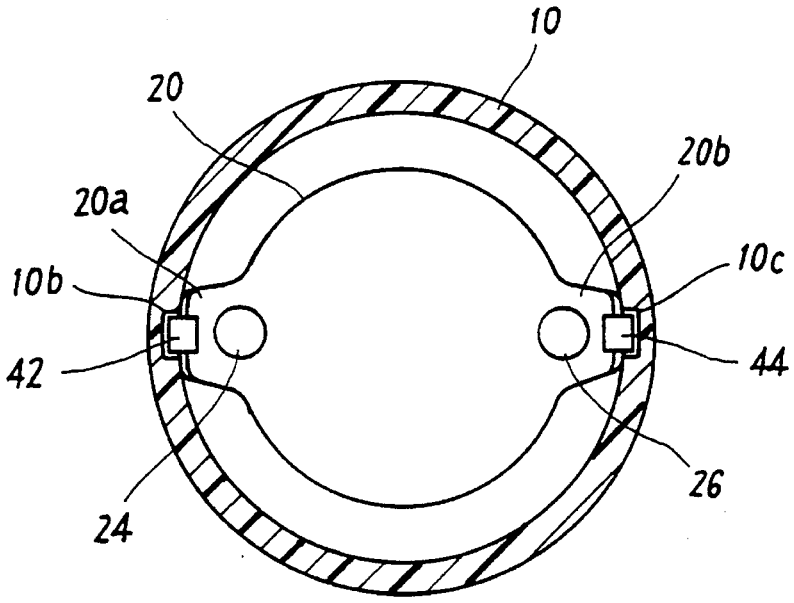
FIG. 8 shows a cross-sectional plane view of a guide means for coupling members for the present invention.

The coupling members 42 and 44 may be engaged with the auxiliary bimetal 40 in a joined or non-joined separated state, but it is preferable that they be engaged in a non-joined or independent state. This allows the action of the main bimetal element 20 for overcurrent protection to operate independent of the action of auxiliary bimetal element 40. A suitable guiding member such as a slot may be provided in the casing 10 for supporting these coupling members 42 and 44 in a freely sliding fashion. As is shown in FIG. 8, grooves 10*b* and 10*c* can be provided on the inner walls of the casing 10 to house the coupling members 42 and 44 and permit freely sliding of them in the longitudinal direction.

In the case where the coupling members 42 and 44 are made from a metal or other electrically conductive material, there may be cases where the electric current passing through these coupling members 42 and 44 might produce a spark between them and the main bimetal 20 or the auxiliary bimetal 20.

Figure 9:
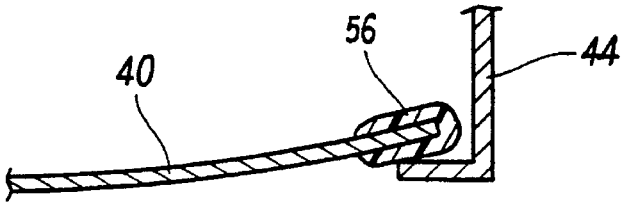
FIG. 9 shows an enlarged cross-sectional view of the construction between coupling member and an auxiliary bimetal member.

Generally, in operation this is not a problem. However, if desired, to completely eliminate the possibility of a spark, it is only necessary to construct the coupling members 42 and 44 with an insulating material. In the alternative, an insulating material such as an insulating tape 56 may be pasted to that portion of the auxiliary bimetal 40 which contacts the coupling members 42 and 44 as is shown in FIG. 9.

Figure 10:
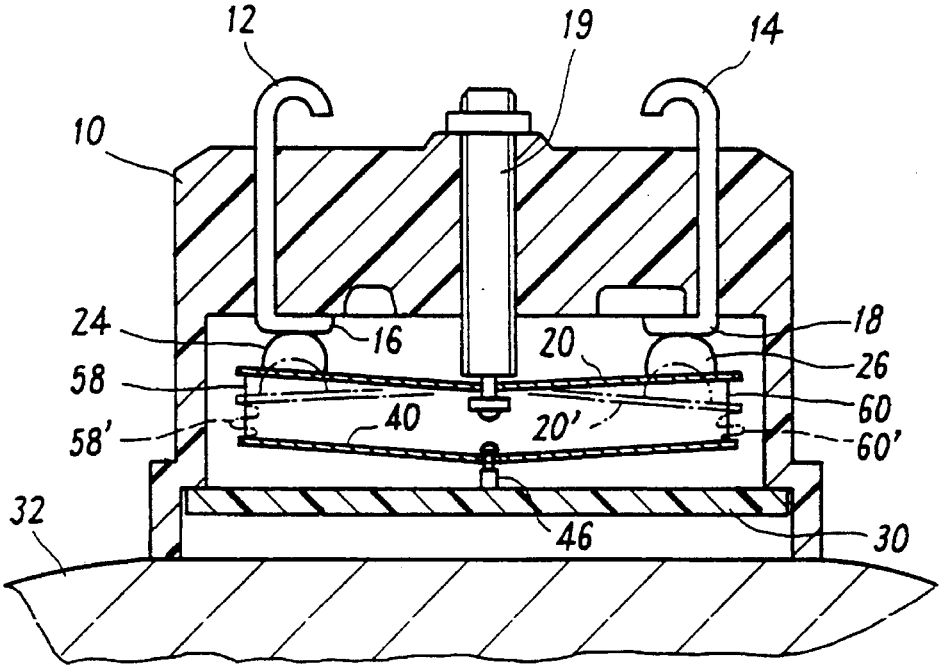
FIG. 10 shows a cross-sectional view of a deformed example of the coupling member.

FIG. 10 shows still another embodiment of the present invention. In this case, coupling members 42 and 44 are wires 58, 60 whose flexibility is high. The top and the bottom of each wire 58 and 60 is fixed to the main bimetal 20 and the auxiliary bimetal 40. In the state of the auxiliary bimetal 40 being located a first position (limited thermal heat), the strings 58 and 60 will bend as indicated by the dotted lines 58' and 60' when the main bimetal element 20 snaps overcenter and is displaced from the first position indicated by a solid line to the second position indicated by a dotted line.

However, when the auxiliary bimetal 40 snaps over center and is displaced from the first position to the second position, the displacement is transmitted to the main bimetal 20 through the string 58 and 60, and as a result, the main bimetal element 20 also snaps overcenter and is displaced from the first position to the second position.

It is mentioned in connection with these embodiments that the heating resistance member 28 may be eliminated as shown in the example in FIG. 10 with the main bimetal 20 being resistance heated solely by its own heating.

The shape of the main bimetal is optional. In the case of the auxiliary bimetal, too, the shape is not limited to the disk shape; but it can be rectangular or can assume any other given shape. Moreover, the heat responsive member of this invention is not limited to the bimetal; but it may be formed by using a shape memorizing alloy that is deformed or displaced at a prescribed temperature.

Further, in the aforementioned examples, the construction is such that at the time when movable contacts 24 and 26 are joined with the main bimetal 20 and the switch circuit is closed, the main bimetal 20 may become electrically conductive so as to carry out self-heating. Nevertheless, it is not always necessary for the movable contacts and the main bimetal 20 to be integrally together. It can be so constructed that at the time when the switch circuit is closed, the main bimetal 20 may not become electrically conductive; but it is heated by the resistance heating of the resistance heater.

Regarding the switch circuit, too, it is not limited to a pair of contacts (16 and 24) and (18 and 26) as shown in the above examples; but can be constructed using one contact pair.

The aforementioned examples are especially useful for protective devices suitable for use in the protection of the motor, and especially useful for small tightly-sealed type compressors. However, the overcurrent protective device equipped with an overheat preventative function can be used in the protection of other electric machines and electric apparatus.

Figure 11:
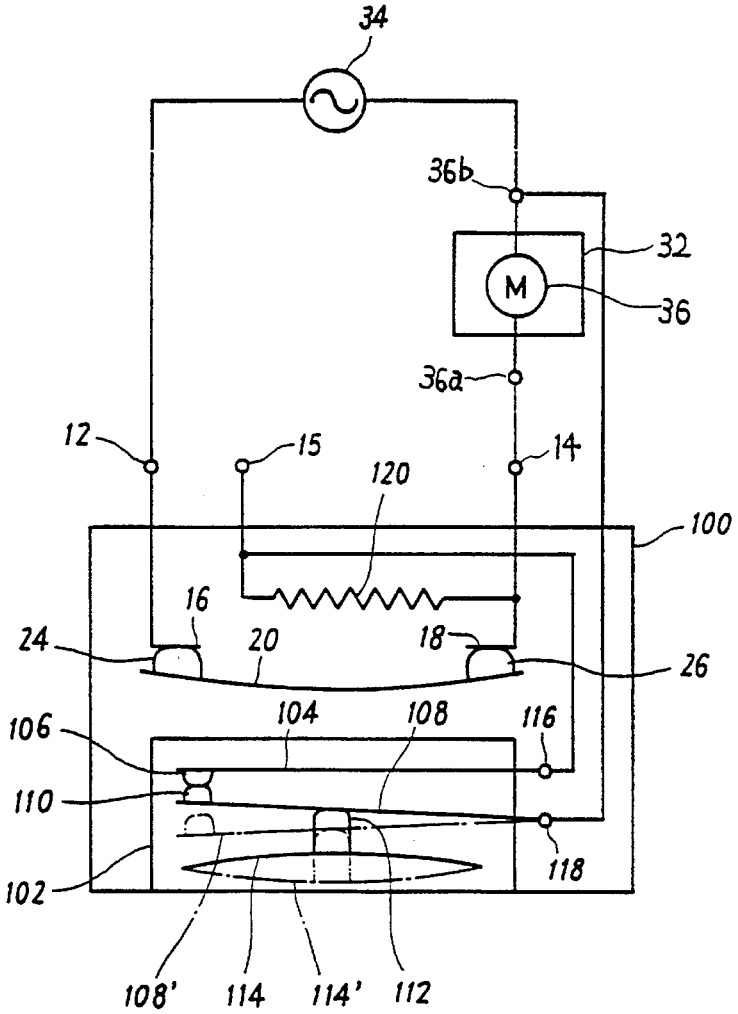
FIG. 11 shows the electrical circuitry of a motor protection device according to a sixth embodiment of this invention.

Lastly, another alternative, although not having all of the advantages of the above devices, would be to build a motor protector and a thermostat in one casing as shown in FIG. 11.

A casing 100 is provided for the protective device shown in FIG. 11 and is markedly larger than the casing 10 for the aforementioned motor protector. A thermostat 102 which has been molded with resin is accommodated in its bottom. Inside this thermostat 102, a fixed contact 106 which is fixed to the tip of a fixed arm 104 and a movable contact is fixed to the tip of a movable arm 108 are positioned in such a manner as to face each other in a vertical direction. A bimetal element 114 is arranged through an operating rod 112 under the movable arm 108. The terminals of the fixed arm 104 and the movable arm 108 are electrically connected to the third terminal 15 and the terminal **36*b* of the motor 32 as is the terminals 116 and 118**.

In this protective device, the radiant heat from the compressor is received by the thermostat 102. At the time when the temperature from the compressor happens to be lower than the action temperature of the bimetal 114, the bimetal 114 is at such a position that its center is curved downward as shown by a dotted line 114'. Accordingly, an operating rod 112 and the movable arm 108 are in such a position so that movable contact 110 is separated from the fixed contact 106 and the switch circuit of the thermostat 102 is open.

In this state no electric current flows to the heating resistor 120, and the heating resistor 120 does not produce resistance heat. The bimetal 20 is heated essentially by only its own resistance heat; and thus, snaps over center in overcurrent situations to separate the movable contacts (24, 26) from the fixed contacts (16, 18) to shut off the current independent of heat from resistor 120.

When, however, there is a state of conditions such as a leak of the coolant as has been described above, the temperature of the compressor rises and the bimetal 114 of the thermostat 102 snaps to a position shown by the solid line in FIG. 11 at a prescribed action temperature. Correspondingly, the movable arm 108 is raised to the position indicated by the solid line, with the movable contact 110 compressively contacting the fixed contact 106 resulting in the switch circuit of the thermostat 102 to be closed.

Upon this closure, an electric current bypass circuit consisting of a heating resistor 120 and the thermostat 102 is formed in parallel with the motor 36 and the heating resistor 120 becomes electrically conductive, thereby generating resistance heat. Because of the resistance heating of this heating resistor 120, the temperature of the bimetal 20 rises suddenly; and when the temperature reaches the aforementioned prescribed action temperature, the bimetal element 20 snaps over center to separate fixed contacts 16 and 18 from the movable contacts 24 and 26. The electric current is now open.

The heating resistor 120 which is connected between the second terminal 14 and the third terminal 15 in this above described protective device only becomes electrically conductive at the time when the contact of the thermostat 102 are engaged due to overheating of the compressor. The resistor 120 in this state rapidly supplies heat to cause bimetal element 20 to snap over center. It has a resistance value which is entirely different and larger from the heating resistor 28 for overcurrent protection.

Accordingly, it should be understood that although particular embodiments of this invention have been described by way of illustrating the invention, the invention includes all modifications and equivalences of the disclosed embodiments falling within the scope of the appended claims.

I claim:

1. A protector for an electrical device comprising a fixed contact means which is electrically connected to said electrical device, a movable contact means positioned to make contact with said fixed contact means, a bimetallic element capable of movement between a first position to cause said movable contact means to engage said fixed contact means and a second position to cause said movable contact means to be separated from said fixed contact means in response to heat generated reflecting the electric current that flows to said electrical device, heat responsive means in thermal communication with said electrical device which is displaced to a prescribed position when said heat responsive means is heated to a prescribed temperature reflecting the temperature of said electrical device, and a coupling means for transmitting the displacement of said heat responsive means to said bimetallic element thereby forcefully moving said bimetallic element from said first to said second position.

2. A protector for a motor with a separate overheat prevention function comprising a housing, a fixed contact means contained within said housing which is electrically connected to said motor, a movable contact means contained within said housing positioned to make contact with said fixed contact means, a bimetallic element in the housing capable of movement between a first position to cause said movable contact means to engage said fixed contact means and a second position to cause said movable contact means to separate from said fixed contact means at a first action temperature in response to heat generated reflecting the electric current level that flows to said motor, heat responsive means in thermal communication with said motor which is displaced from an original position to a second prescribed position when said heat responsive means is heated to a second action temperature reflecting the temperature of said motor, and a coupling means for transmitting the displacement of said heat responsive means to said bimetallic element thereby forcefully moving said bimetallic element from said first position to said second position.

3. A protector as set forth in claim 2 wherein said first action temperature is above said second action temperature.

4. A protector as set forth in claim 2 wherein said bimetallic element acts independently from said heat responsive means in reflecting the electric current that flows to said motor.

5. A protector as set forth in claim 2 wherein said coupling means receives and at least partially contains said bimetallic element and such heat responsive means and is freely slidable in said housing.

6. A protector as set forth in claim 2 further including an auxiliary heater to provide heat to said bimetallic element in response to heat generated reflecting the electric current level that flows to said motor.

7. A protector as set forth in claim 2 wherein said heat responsive means is another bimetallic element.

8. A protector as set forth in claim 7 in which a reset temperature for said another bimetallic element is below normal operating temperature of said motor thereby making the protector require manual reset.

9. A protector of claim 2 wherein said housing contains all components of the protector in a compact device.

10. A protector of claim 7 wherein said another bimetallic element has a spring constant which is sufficiently greater than the spring constant for said bimetallic element so as not to allow reset of the bimetallic element from said second position back to said first position until said another bimetallic element has moved back from said second prescribed position to said original position if said another bimetallic element has once moved to said second prescribed position.

11. A protector for a motor with a separate overheat prevention function comprising a housing, a fixed contact means contained within said housing which is electrically connected to said motor, a movable contact means contained within said housing positioned to make contact with said fixed contact means, a first bimetallic element in the housing capable of movement between a first position to cause said movable contact means to engage said fixed contact means and a second position to cause said movable contact means to separate from said fixed contact means at a first action temperature in response to heat generated reflecting the electric current level that flows to said motor, a second bimetallic element in thermal communication with said motor which is displaced from an original position to a second prescribed position when said second bimetallic element is heated to a second action temperature reflecting the temperature of said motor, said second bimetallic element having a reset temperature below normal operating temperature of said motor thereby making the protector require manual reset, a coupling means for transmitting the displacement of said second bimetallic element to said first bimetallic element thereby forcefully moving said first bimetallic element from said first position to said second position, and a manual reset means to reset said second bimetallic element back to said original position.

* * * * *